US007771910B2

(12) United States Patent
Yamazaki et al.

(10) Patent No.: US 7,771,910 B2
(45) Date of Patent: Aug. 10, 2010

(54) IMAGE FORMING METHOD

(75) Inventors: Hiroshi Yamazaki, Hachioji (JP); Hiroyuki Yamada, Tsukui-machi (JP); Tomoe Kitani, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 562 days.

(21) Appl. No.: 10/924,593

(22) Filed: Aug. 23, 2004

(65) Prior Publication Data

US 2006/0040198 A1 Feb. 23, 2006

(51) Int. Cl.
*G03G 13/08* (2006.01)

(52) U.S. Cl. ..... 430/123.5; 430/125.3; 430/110.3; 430/110.4; 430/124.1; 430/124.4

(58) Field of Classification Search ..... 430/124, 430/126, 110.3, 110.4, 124.1, 124.4; 399/319
See application file for complete search history.

(56) References Cited

U.S. PATENT DOCUMENTS 3,653,758 A * 4/1972 Trimmer et al. ..... 399/319
4,679,929 A * 7/1987 Haneda et al. ..... 399/231
5,729,809 A * 3/1998 Haneda et al. ..... 399/308
6,296,980 B1 * 10/2001 Oshiba et al. ..... 430/110.3
2003/0027072 A1 * 2/2003 Horiuchi et al. ..... 430/110.1
2003/0190547 A1 * 10/2003 Kobayashi et al. ..... 430/125
2005/0037273 A1 * 2/2005 Shibata et al. ..... 430/59.6

FOREIGN PATENT DOCUMENTS

JP 2001-100546 4/2001
JP 2001-100546 A 4/2001
JP 2001-340417 7/2002

* cited by examiner

*Primary Examiner*—Mark F Huff
*Assistant Examiner*—Peter L Vajda
(74) *Attorney, Agent, or Firm*—Frishauf, Holtz, Goodman & Chick, P.C.

(57) ABSTRACT

An image forming method is disclosed, comprising (a) forming a toner image on an image forming body, (b) transporting the image forming body to a transfer region, (c) overlapping an image supporting body onto the image forming body, (d) radiating ultrasonic waves onto the image forming body and the image supporting body by an ultrasonic radiation means with applying an electric field between the image forming body and the image supporting body to transfer the toner image onto the image supporting body and (e) subjecting the toner image on the image supporting body to contact heat-fixing to fix the toner image, wherein a toner is comprised of toner particles containing a resin, a colorant and a releasing agent, and the toner particles exhibiting a coefficient of variation of shape factor of not more than 16% and a coefficient of variation of number particle size distribution of not more than 27%.

10 Claims, 8 Drawing Sheets

FIG. 10 ( a )
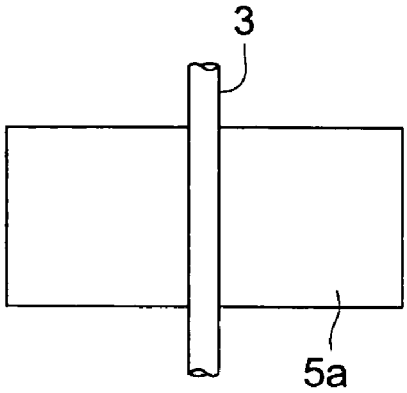
FIG. 10 ( b )
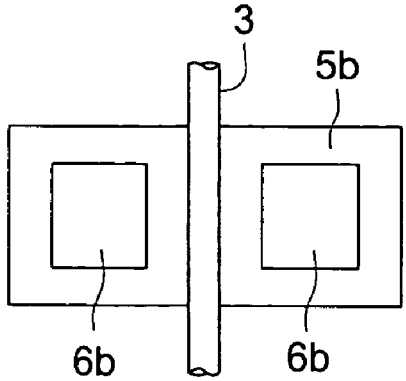
FIG. 10 ( c )
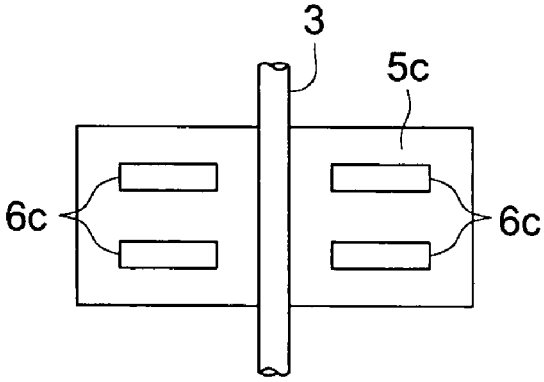
FIG. 10 ( d )
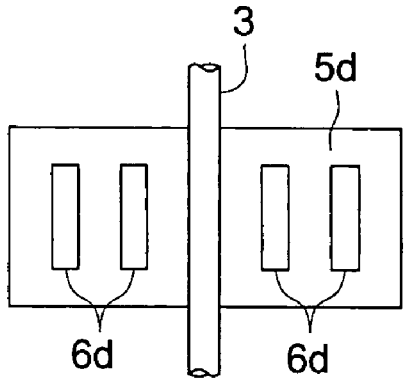

FIG. 11 ( a )
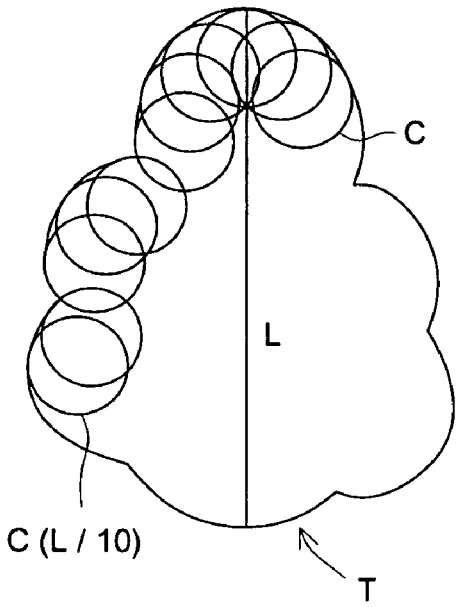
FIG. 11 ( b )
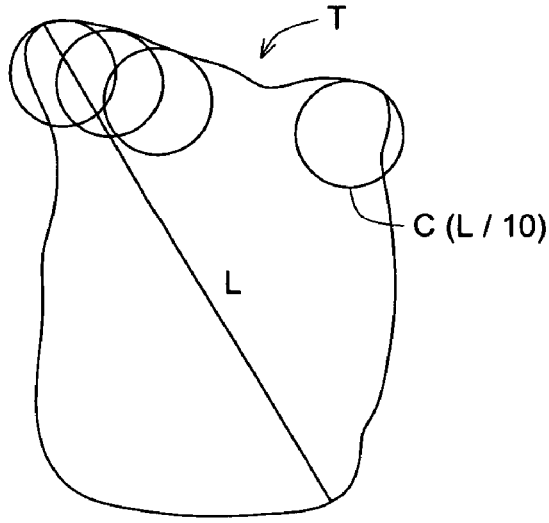
FIG. 11 ( c )
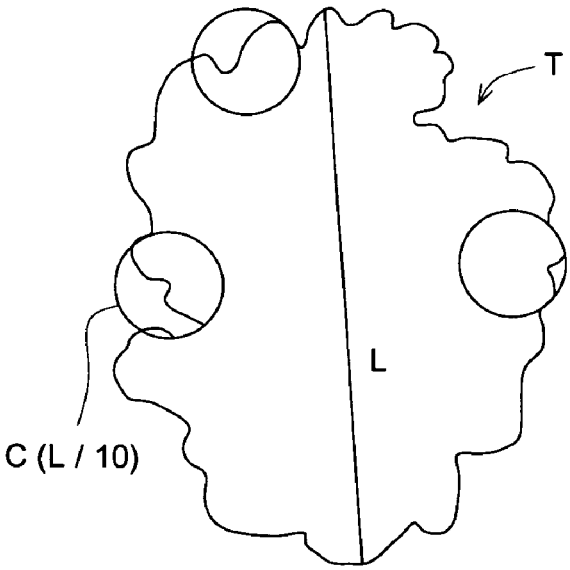

IMAGE FORMING METHOD

BACKGROUND

1. Technical Field

The present invention relates to an image forming method comprising forming electrostatic image on an image forming material, transferring the image onto an image support, followed by contact heat fixation.

2. Related Art

Recently, image forming apparatuses requiring high speed and high quality images employ an image forming method in which electrostatic image formation is performed on an image forming material, and an image obtained by toner development is transferred onto an image support and subjected to contact heat-fixation.

One remaining matter to be solved in this image forming method is the problem that disarrangement of the image is caused in the stage of transferring the image obtained in toner development to an image support.

There have been proposed various methods such as adhesion transfer and contact transfer to overcome such a problem. However, in the adhesion transfer or contact transfer, problems arise with high-speed processing, producing defects that an increased amount of toner to be transferred renders it difficult to raise transfer efficiency. Specifically, color images result in an increased toner amount, compared to convention monochromatic images so that it is difficult to completely transfer a toner image, whereby problems becoming more pronounced.

As an improvement in the method of performing transfer employing an electric field, there was proposed a method in which ultrasonic waves are applied at the time of transfer to enhance transfer efficiency, as disclosed in JP-A No. 2001-100546 (hereinafter, the term JP-A refers to unexamined Japanese Patent Application Publication). This method can exclude non-uniformity in toner and is useful as a method enabling efficient transfer of the toner. However, ultrasonic vibration scatters the toner, disadvantageously inducing problems such as scattering of toner or mixing of colors in images.

SUMMARY

It is an object of the present invention to provide an image forming method preventing scattering in characters and mixing of colors even in an ultrasonic transfer system, resulting in enhanced fine-line reproducibility, causing no change in tincture of color images and exhibiting high image quality and enhanced transfer efficiency.

Thus, in one aspect the invention is directed to An image forming method comprising (a) forming a toner image on an image forming body, (b) transporting the image forming body to a transfer region, (c) overlapping an image supporting body onto the image forming body, (d) radiating ultrasonic waves onto the image forming body and the image supporting body by an ultrasonic radiation means with applying an electric field between the image forming body and the image supporting body to transfer the toner image onto the image supporting body and (e) subjecting the toner image on the image supporting body to contact heat-fixing to fix the toner image, wherein a toner is comprised of toner particles containing a resin, a colorant and a releasing agent, and the toner particles exhibiting a coefficient of variation of shape factor of not more than 16% and a coefficient of variation of number particle size distribution of not more than 27%.

In another aspect the invention is directed to an image forming apparatus comprising an image forming body to form a toner image thereon, a developing device and a transfer device, and an image is formed by the method described above.

The present invention has come into being as a result of studying effects of ultrasonic vibration in detail and further making detailed analysis of toner particles to cause scattering of characters and mixing of colors.

The method of transfer employing ultrasonic is assumed to be that ultrasonic vibration causes toner particles to uniformly level out on the surface of the image forming body (which is often a photoreceptor and therefore called a photoreceptor), so that an electric field at the time of transfer is uniformly applied to the toner particles, resulting in enhanced transferability. However, such effects are scattered, often causing deterioration of toner images.

Detailed analysis of these phenomena revealed that transfer employing ultrasonic waves is greatly affected by the shape and/or size of toner particles. It is assumed that in cases when the properties of toner particles are uneven, in other words, the toner particles have a distribution in shape or size, the ultrasonic vibration is not homogeneously transmitted, and minute particles or markedly irregular formed particles slip out of place due to the ultrasonic vibration. Specifically, in the case of a multilayer structure, it is contemplated that there is a difference in adhesion between toner particles existing in the portion in contact with the surface of a photoreceptor and those existing in the upper portion and such a difference is further amplified by the difference in adhesion force of the toner particles.

BRIEF EXPLANATION OF DRAWING

FIGS. 10(*a*) to 10(*d*) illustrate exemplary blade forms.

FIG. 11(*a*) illustrates a particle having no corner and

FIGS. 11(*b*) and 11(*c*) illustrate a particle having a corner.

EMBODIMENTS OF THE INVENTION

Figure 1:
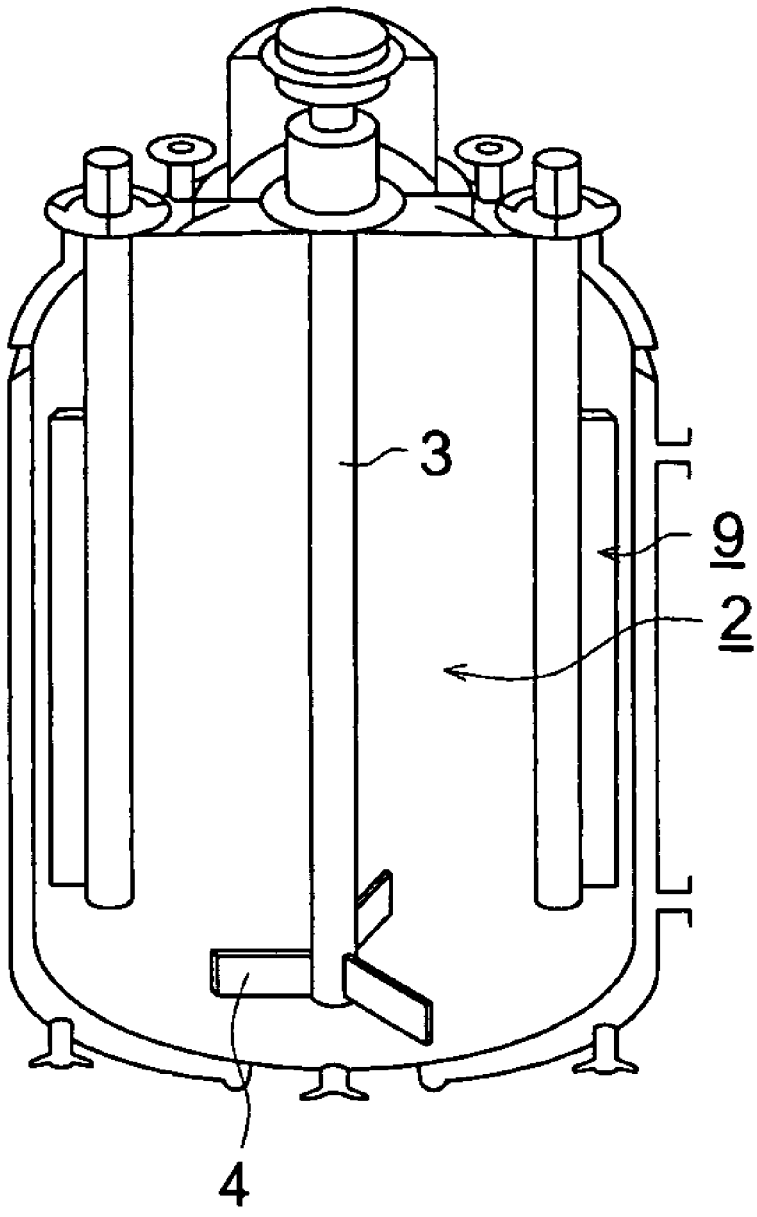
FIG. 1 is an explanatory view of a reaction apparatus.

The toner used in this invention comprises toner particles exhibit a coefficient of variation of shape factor of not more than 16% and a coefficient of variation of number particle size distribution of not more than 27%. In one preferred embodiment, toner particles having no corners account for at least 50% by number and a coefficient of variation of number particle size distribution of not more than 27%. In another preferred embodiment, toner particles exhibiting a shape factor of 1.2 to 1.6 account for at least 65% by number and a coefficient of variation of shape factor is not more than 16%.

The shape factor (which is also called shape coefficient) and the coefficient of variation of shape factor, the coefficient of variation of particle size distribution based on number (which is hereinafter also denoted simply as number particle size distribution) and the proportion of particles having no corners are defined as below.

In most of toners currently used, external additives such as silica fine-particles are incorporated. The toner particles relating to this invention include those before having been added with an external additive and those after having been added with an additive. In cases when they are specified, the former are called a colored particles and the latter, toner particles. There is no difference between before and after being added with an external additive, with respect to measure values relating to the foregoing shape factor and a coefficient of variation thereof, coefficient of variation of number particle size distribution, proportion of particles having no corners and toner particle size.

The shape factor of the toner particles is defined according to the following equation, indicating the degree of roundness of toner particles:

$$\text{Shape factor}=[(\text{maximum diameter}/2)^2\times\pi]/(\text{projected area})$$

wherein when projection of a toner particle onto the plane is sandwiched between two parallel lines, the maximum diameter is the width of the particle at the time when the spacing between two parallel lines is the greatest; and the projected area is the area of the toner particle projected onto the plane. The shape factor can be determined in a manner that toner particles are photographed using an electron-microscope at a magnification factor of 2000 and the obtained electron-micrograph is analyzed using SCANNING IMAGE ANALYZER (product of Nippon Denshi Corp.). The measurement is conducted for 100 toner particles and the shape factor was determined based on the foregoing formula.

In one embodiment, toner particles exhibiting a shape factor of 1.0 to 1.6 preferably account for at least 65% (more preferably at least 70%) by number of all the particles. It is further preferred that toner particles exhibiting a shape factor of 1.2 to 1.6 account for at least 65% (preferably at least 70%) by number of all the particles. Toner particles of a shape factor of 1.0 to 1.6 accounting for at least 65% results in rounded forms, rendering it difficult to be affected by repeated charging and forming superior image quality without causing excessively increased adhesion onto the photoreceptor. The packing density of toner particles in the toner layer formed on the photoreceptor rises, resulting in reduced change when transferred to the image supporting body and thereby maintaining superior transferability. Furthermore, toner particles become difficult to be milled, resulting reduced staining in the charging member and charging characteristics are stabilized, resulting in reduced scattering in adhesion property between different colors, leading to stabilized color image formation.

In another preferred embodiment, toner particles exhibiting a shape factor of 1.2 to 1.6 account for at least 65% by number (preferably at least 70% by number) of total particles, thereby resulting in enhanced uniformity and rendering it difficult to be affected by repeatedly charging.

Methods for controlling the shape factor are not specifically limited, and include, for example, a method of spraying toner particles into a stream of hot air, a method of repeatedly providing mechanical energy by an impact force to toner particles in a gas phase, a method of subjecting a toner into a circulating stream in a non-dissolvable solvent, and a method in which toner particles having a shape factor of 1.0 to 1.6 or 1.2 to 1.6 are prepared and added to a conventional toner so as to fall within the intended range. Alternatively, the shape of the whole particle is controlled in the stage of preparing a so-called polymerization toner and toner particles having a shape factor of 1.0 to 1.6 or 1.2 to 1.6 are added to a conventional toner to-control the shape factor.

Of the foregoing methods, a polymerization toner is preferred in terms of simplified preparation thereof and also in terms of superior uniformity of the particle surface, compared to a pulverized toner.

The coefficient of variation (hereinafter, also denoted simply as variation coefficient) of the shape factor of the toner particles is calculated using the following equation:

$$\text{Coefficient of variation of shape factor (\%)}=(S_1/K)\times 100$$

wherein $S_1$ represents the standard deviation of the shape factor of 100 toner particles and K represents the average shape factor of the toner particles.

The coefficient of variation of the shape factor is generally not more than 16 percent, and is preferably not more than 14 percent. By adjusting the coefficient of variation of the shape factor to 16 percent or less, voids in the transferred toner layer are reduced, improving fixability and minimizing the formation of offsetting. Further, the resultant charge amount-distribution narrows, improving image quality.

In order to uniformly control the shape factor of toner particles as well as the coefficient of variation of the shape factor with minimal fluctuation among production lots, the optimal finishing time of processes may be determined while monitoring the properties of forming toner particles (colored particles) during the processes of polymerization to form resin particles (polymer particles), fusion and shape control of the resin particles.

Monitoring, as described herein, means that measurement units are installed in-line, and process conditions are controlled based on measurement results thereof. Namely, a shape measurement unit, and the like, is installed in-line. For example, in a polymerization method, toner, which is formed employing fusion or coagulation of resin particles in a water-based medium, during processes such as fusion, the shape as well as the particle diameters, is determined while sampling is successively carried out, and the reaction is terminated when the desired shape is achieved.

The monitoring methods are not particularly limited, but one method is to use flow system particle image analyzer FPIA-2000 (manufactured by Toa Iyodenshi Co.). The analyzer is suitable because it is possible to monitor the shape upon carrying out image processing in real time, while allowing a sample composition to pass through. Namely, monitoring is always carried out while running the sample composition from the reaction location employing a pump and the like, and the particle shape and the like are measured. The reaction is terminated when the desired shape is achieved.

The number particle size distribution of the toner particles and a coefficient of variation of the number particle size distribution can be determined, employing Coulter Counter TA-11 or Coulter Multisizer (both manufactured by Coulter Corp.). In this invention, there was employed the Coulter Multisizer which was connected to an interface which outputs the particle size distribution (manufactured by Nikkaki), as well as on a personal computer. Employed as the Multisizer was one having a 100 μm aperture. The volume and the number of particles having a diameter of at least 2 μm were determined and the size distribution as well as the average particle diameter was calculated. The number particle size distribution, as described herein, represents the relative frequency of toner particles of a specified particle diameter, and the number average particle diameter, as described herein, expresses the median diameter in the number particle size distribution.

The coefficient of variation of the number particle size distribution of a toner (hereinafter, also denoted simply as number variation coefficient) is calculated employing the formula described below:

$$\text{Number variation coefficient}=(S_2/D_n)\times 100 \text{ (in percent)}$$

wherein $S_2$ represents the standard deviation in the number particle size distribution, and $D_n$ represents the number average particle diameter (in μm).

The number variation coefficient of the toner particles of the present invention is preferably not more than 27 percent, and is more preferably not more than 25 percent. By adjusting the number variation coefficient to not more than 27 percent, adhesion onto a photoreceptor becomes homogeneous and toner particles are disintegrated by ultrasonic at the time of transfer, resulting in enhanced transferability and leading to enhanced color reproduction.

Methods to control the number variation coefficient of the present invention are not particularly limited. For example, employed may be a method in which toner particles are classified employing forced air. However, in order to further decrease the number variation coefficient, classification in liquids is also effective. In the methods, by which classification is carried out in a liquid, is one employing a centrifuge so that toner particles are classified in accordance with differences in sedimentation velocity due to differences in the diameter of toner particles, while controlling the rotation speed.

Specifically, when a toner is produced employing a suspension polymerization method, in order to adjust the coefficient of variation of the number particle size distribution to not more than 27 percent, a classifying operation may be employed. In the suspension polymerization method, it is preferred that prior to polymerization, polymerizable monomers are dispersed into a water based medium to form oil droplets equal to the desired size of the toner. Namely, large oil droplets of the polymerizable monomers are subjected to repeated mechanical shearing employing a homomixer, a homogenizer, and the like to decrease the size of oil droplets to approximately the same size as the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be inevitable.

In the embodiments of this invention, toner particles having no corners preferably account for at least 50% by number (more preferably at least 70% by number). Toner particles accounting for at least 50% by number enhances efficiency of transmittance of ultrasonic vibration, resulting in minimized color contamination or mixing of colors, leading to enhanced color reproduction.

Toner particles having no corners, as described herein, refer to those having substantially no projections on which charges concentrate or which tend to be worn down by stress. Namely, as shown in FIG. 11(*a*), the main axis of toner particle T is designated as L. Circle C, having a radius of L/10, which is positioned in toner T, is rolled along the periphery of toner T, while being in contact with the circumference. When it is possible to roll any part of the circle without substantially crossing over the interior circumference of toner T, a toner is designated as "a toner particle having no corners". The expression, "without substantially crossing over the circumference" means that there is at most only one projection at which any part of the rolled circle crosses over the circumference. Further, "the main axis of a toner particle" as described herein refers to the maximum width of the toner particle when the projection image of the toner particle onto a flat plane is placed between two parallel lines. FIGS. 11(*b*) and 11(*c*) show the projection of a toner particle with corners.

The proportion of toner particles having no corners are measured as follows. First, an image of a magnified toner particle is made employing a scanning type electron microscope. The resultant image of the toner particle is further magnified to obtain a photographic image at a magnification factor of 15,000. Subsequently, employing the resultant photographic image, the presence and absence of the corners is determined. The measurement is carried out for 100 random toner particles.

Methods for preparing toner particles having no corners are not specifically limited. As described in the method for controlling the shape factor, a method of spraying toner particles into a stream of hot air, a method of repeatedly providing mechanical energy by an impact force to toner particles in a gas phase, and a method of subjecting a toner into a circulating stream in a non-dissolvable solvent are applicable.

Further, in a polymerization toner which is formed by allowing resin particles to be aggregated or fused, or coalescing resin particles, during the fusion terminating stage, the fused particle surface is markedly uneven and has not been smoothed. However, by optimizing conditions such as temperature, rotation speed of stirring blades, stirring time, and the like, during the shape controlling process, it is possible to prepare toner particles having no corners. These conditions vary depending on the physical properties of the resin particles. For example, by setting the temperature higher than the glass transition point of the resin particles, as well as employing a higher rotation frequency, the surface is smoothened. Thus it is possible to form toner particles substantially having no corners.

Uniformity in shape of each of yellow, magenta, cyan and black toner particles minimizes variation in transfer among particles during ultrasonic vibration, thereby resulting in enhanced color reproduction. Thus, when a shape factor (Ky), a coefficient of variation of the shape factor (Kσy), number average particle diameter (Dy) and a coefficient of variation of number particle size distribution (Dσy) of a yellow toner; a shape factor (Km), a coefficient of variation of the shape factor (Kσm), number average particle diameter (Dm) and a coefficient of variation of number particle size distribution (Dσm) of a magenta toner; a shape factor (Kc), a coefficient of variation of the shape factor (Kσc), number average particle diameter (Dc) and a coefficient of variation of number particle size distribution (Dσc) of a cyan toner; and a shape factor (Kb), a coefficient of variation of the shape factor (Kσb), number average particle diameter (Db) and a coefficient of variation of number particle size distribution (Dσb) of a black toner meet the following relationships (1) to (4), the difference in adhesion property or charging property between colors can be reduced even in a system of undergoing development plural times on the photoreceptor, resulting in enhanced color reproduction. Further, there is no difference in electrostatic behavior between toners in the stage of transfer onto the image forming support or in the fixing stage so that superior color images can be formed without causing deteriorated image quality.

$$0\leqq\{(\text{maximum value of } Ky, Km, Kc \text{ and } Kb)-(\text{minimum value of } Ky, Km, Kc \text{ and } Kb)\}/(\text{maximum value of } Ky, Km, Kc \text{ and } Kb)\leqq 0.20 \quad (1)$$

$$0\leqq\{(\text{maximum value of from } K\sigma y \text{ to } K\sigma b)-(\text{minimum value of from } K\sigma y \text{ to } K\sigma b)\}/(\text{maximum value of from } K\sigma y \text{ to } K\sigma b)\leqq 0.30 \quad (2)$$

$$0 \leqq \{(\text{maximum value of from } Dy \text{ to } Db) - (\text{minimum value of from } Dy \text{ to } Db)\}/(\text{maximum value of from } Dy \text{ to } Db) \leqq 0.15 \quad (3)$$

$$0 \leqq \{(\text{maximum value of from } D\sigma y \text{ to } D\sigma b) - (\text{minimum value of from } D\sigma y \text{ to } D\sigma b)/(\text{maximum value of from } D\sigma y \text{ to } D\sigma b) \leqq 0.25 \quad (4)$$

The diameter of the toner particles of the present invention is preferably from 3 to 8 μm in terms of the number average particle diameter. When toner particles are formed employing a polymerization method, it is possible to control the particle diameter utilizing the concentration of coagulants, the added amount of organic solvents, the fusion time, or further, the composition of the polymer itself. A number average particle diameter of 3 to 8 μm can enhance transferability onto the image forming support without excessively increasing the respective toner layers. Further, enhanced transfer efficiency enhances image quality in the halftone and image qualities of fine line and dots are also enhanced.

It is preferred that, in a histogram of particle size distribution based on number in which the toner particle size is designated D (μm), natural logarithmic lnD is laid off as abscissa and the abscissa is divided into plural groups at an interval of 0.23, the sum (M) of a relative frequency (m1) of toner particles contained in the highest frequency group and the relative frequency (m2) of toner particles contained in the next highest frequency group is at least 70%. At least 70% of the sum (M) of a relative frequency (m1) and a relative frequency (m2) leads to a narrower particle size distribution and occurrence of selective development can definitely be inhibited by the use of such a toner in the imaging process.

In this invention, the foregoing histogram indicating a particle size distribution based on number is one in which the abscissa of natural logarithmic lnD is divided at intervals of 0.23 into plural groups (0.00-0.23: 0.23-0.46: 0.46-0.69: 0.60-0.92: 0.92-1.15: 1.15-1.38: 1.38-1.61: 1.61-1.84: 1.84-2.07: 2.07-2.30: 2.30-2.53: 2.53-2.76 . . . ). Particle size data of a sample which is measured using a Coulter multisizer according to the following condition, are transferred to a computer via an I/O unit and the foregoing histogram is prepared using a particle size distribution analysis program.

Measurement Condition:

(1) Aperture: 100 μm (2) Sample preparation: To 50 to 100 ml of an electrolyte (ISOTON R-11, a product of Coulter Scientific Japan Corp.), an optimum amount of a surfactant (neutral detergent) is added with stirring and 10 to 20 mg of a measurement sample is added thereto; this mixture is dispersed using an ultrasonic homogenizer over a period of 1 min.

In the case of a toner which has been prepared by the conventional pulverization process (hereinafter, also denoted simply as a pulverization toner), toner particles exhibiting a shape factor of 1.2 to 1.6 account for about 60% by number of total particles. The coefficient of variation of a shape factor is about 20%. In the pulverization process, pulverization is repeated to reduce the particle size so that angular portions of the particles increase and toner particles having no corners account for 30% by number or less. Accordingly, to obtain toner particles which are uniform in shape, rounded and have no corners, it needs to be subjected to a treatment for sphering, such as a thermal treatment.

The number variation coefficient of number particle size distribution is about 30% in cases when after pulverization, a classification operation is conducted one time and it therefore needs to further repeat the classification operation to reduce the number variation coefficient to 27% or less.

In the case of a toner which has been prepared by the process of suspension polymerization (hereinafter, also denoted simply as suspension polymerization toner), the toner is conventionally prepared in the laminar flow, resulting in spherical particles. In the toners disclosed in JP-A No. 56-130762, for example, toner particles exhibiting a shape factor of 1.2 to 1.6 account for about 20% by number, the coefficient of variation of shape factor is about 18% and toner particles having no corners account for about 85% by number. To control the number variation coefficient of number particle size distribution, large-size oil droplets of a polymerization monomer are repeatedly subjected to a mechanical shearing treatment to reduce the oil droplet size to a level of toner particles, resulting in a broadened droplet size distribution and leading to toner particles exhibiting a broadened particle size distribution having a number variation coefficient of about 32%, so that a classification operation is needed to reduce the number variation coefficient.

In a polymerization toner which is formed by the process of allowing resin particles to be aggregated or fused, for example, JP-A No. 63-186253 discloses toner particles, in which particles exhibiting a shape factor of 1.2 to 1.6 account for about 60% by number, the variation coefficient of shape factor is about 18% and toner particles having no corners account for about 44% by number. The toner particle size distribution is broadened, resulting in a number variation coefficient of about 30%, so that a classification operation is needed to reduce the number variation coefficient.

The toner relating to this invention is one which contains at least a resin, a coloring agent and a releasing agent, preferably one which is obtained by allowing a polymerizable monomer to polymerize in an aqueous medium, more preferably one which is obtained by allowing at least resin particles to fuse in an aqueous medium, and still more preferably one which is formed by allowing a polymerizable monomer containing a releasing agent to polymerize in an aqueous medium, by allowing the obtained resin particles containing a releasing agent to fuse in an aqueous medium or by allowing releasing agent particles and resin particles to be fused.

Next, there will be detailed the method for preparing a toner relating to this invention. The toner can be prepared by the process in which polymer particles (resin particles) are formed by suspension polymerization or by allowing a monomer to emulsion-polymerize in liquid (aqueous medium) added with an emulsifying solution, followed by addition of an organic solvent and a coagulant or the like to cause the resin particles to fuse with each other. The expression, cause to fuse means that plural resin particles are fused with each other, including the case of the resin particles being fused with other particles (for example, colorant particles).

Namely, to the polymerizable monomers are added colorants, and optionally releasing agents, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired toner size, employing a homomixer, a homogenizer, and the like. Thereafter, the resultant dispersion is conveyed to a reaction apparatus which utilizes as the stirring mechanism stirring blades described below, and undergoes polymerization reaction upon heating. After completing the reaction, the dispersion stabilizers are removed, filtered, washed, and subsequently dried, whereby a toner is prepared.

The aqueous medium refers to a medium containing water in an amount of at least 50% by weight.

Further, listed as a method for preparing the toner may be one in which resin particles are subjected to fusion or coagulation, in a water based medium. The method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two types of the dispersion particles of components such as resin particles, colorants, and the like, or fine particles, comprised of resins, and colorants, are associated, specifically in such a manner that after dispersing these in water employing emulsifying agents, the resultant dispersion is flocculated by adding coagulants having a concentration of at least the critical coagulating concentration, and simultaneously the formed polymer itself is heat-fused at a temperature higher than its glass transition temperature, and then while forming the fused particles, the particle diameter is allowed to gradually grow; when the particle diameter reaches the desired value, particle growth is stopped by adding a relatively large amount of water; the resultant particle surface is smoothed while being further heated and stirred, to control the shape, and the resultant particles which incorporate water, is again heated and dried in a fluid state. Further, herein, organic solvents, which are infinitely soluble in water, may be simultaneously added together with the coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether and vinyl ethyl ether; vinyl ketones such as vinyl methyl ketone, vinyl ethyl ketone, and vinyl hexyl ketone; N-vinyl compounds such as N-vinylcarbazole, N-vinylindole, and N-vinylpyrrolidone; vinyl compounds such as vinylnaphthalene and vinylpyridine; as well as derivatives of acrylic acid or methacrylic acid such as acrylonitrile, methacrylonitrile, and acryl amide. These vinyl based monomers may be employed individually or in combinations.

Further preferably employed as polymerizable monomers, which constitute the resins, are those having an ionic dissociating group in combination, and include, for instance, those having substituents such as a carboxyl group, a sulfonic acid group, and a phosphoric acid group, as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, and 3-chloro-2-acid phosphoxypropyl methacrylate.

Further, it is possible to prepare resins having a cross-linking structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo-type or diazo-type polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxy-cyclohexane)propane, and tris-(t-butylperoxy)triazine; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C., as well as a softening point of 80 to 220° C. The glass transition point is determined employing a differential thermal analysis method, while the softening point can be determined employing an elevated type flow tester. Preferred as these resins are those having a number average molecular weight (Mn) of 1,000 to 100,000, and a weight average molecular weight (Mw) of 2,000 to 100,000, which can be determined employing gel permeation chromatography. Further preferred as resins are those having a molecular weight distribution of Mw/Mn of 1.5 to 100, and is most preferably between 1.8 and 70.

Coagulants used for allowing the resin particles to fuse in the aqueous medium are not particularly limited, but those selected from metal salts are more suitable. Specifically, listed as univalent metal salts are salts of alkaline metals such as, for example, sodium, potassium, and lithium; listed as bivalent metal salts are salts of alkali earth metals such as, for example, calcium, magnesium, and salts of manganese and copper; and listed as trivalent metal salts are salts of iron and aluminum. Listed as specific salts may be sodium chloride, potassium chloride, lithium chloride, calcium chloride, zinc chloride, copper sulfate, magnesium sulfate, and manganese sulfate. These may also be employed in combination.

These coagulants are preferably added in an amount higher than the critical coagulation concentration. The critical coagulation concentration, as described herein, refers to an index regarding the stability of water based dispersion and concentration at which coagulation occurs through the addition of coagulants. The critical coagulation concentration markedly varies depending on emulsified components as well as the dispersing agents themselves. The critical coagulation concentration is described in, for example, Seizo. Okamura, et al., "Kobunshi Kagaku (Polymer Chemistry) 17, 601 (1960) edited by Kobunshi Gakkai, and others. Based on the publication, it is possible to obtain detailed critical coagulation concentration data. Further, as another method, a specified salt is added to a targeted particle dispersion while varying the concentration of the salt; the ξ potential of the resultant dispersion is measured, and the critical coagulation concentration is also obtained as the concentration at which the ξ potential varies.

The acceptable amount of the coagulating agents is an amount of more than the critical coagulation concentration. However, the added amount is preferably at least 1.2 times as much as the critical coagulation concentration, and is more preferably 1.5 times.

The solvents infinitely soluble in water, which are used with the coagulating agents (coagulants) refer to those which are infinitely soluble in water, and such solvents are selected which do not dissolve the formed resins. Specifically, listed may be alcohols such as methanol, ethanol, propanol, isopropanol, t-butanol, and methoxyethanol, butoxyethanol. Ethanol, propanol, and isopropanol are particularly preferred.

The added amount of the infinitely soluble solvents is preferably from 1 to 100 percent by volume with respect to the polymer containing dispersion to which coagulants are added.

Incidentally, in order to make the shape of particles uniform, it is preferable that colored particles are prepared, and after filtration, the resultant slurry, containing water in an amount of 10 percent by weight with respect to the particles, is subjected to fluid drying. At that time, those having a polar group in the polymer are particularly preferred. For this reason, it is assumed that since existing water somewhat exhibits swelling effects, the uniform shape particularly tends to be made.

The toner is comprised of at least resins, colorants and releasing agents. However, if desired, the toner may be comprised of charge control agents. Further, the toner may be one added with external additives, comprised of fine inorganic particles, and fine organic particles.

Optionally employed as colorants, which are used in the present invention, are carbon black, magnetic materials, dyes, and pigments. Employed as carbon blacks are channel black, furnace black, acetylene black, thermal black, and lamp black. Employed as ferromagnetic materials may be ferromagnetic metals such as iron, nickel, cobalt, and the like, alloys comprising these metals, compounds of ferromagnetic metals such as ferrite and magnetite, alloys which comprise no ferromagnetic metals but exhibit ferromagnetism upon being thermally treated such as Heusler's alloys such as manganese-copper-aluminum, manganese-copper-tin, and the like, and chromium dioxide.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment-Orange 31, the same 43, C.I. Pigment Yellow 14, the same 17, the same 93, the same 94, the same 138, C.I. Pigment Green 7, C.I. Pigment Blue 15:3, and the same 60, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants, of which surface has been subjected to treatment employing coupling agents, so that radical polymerization is not hindered.

Further, added as fixability improving agents may be low molecular weight polypropylene (having a number average molecular weight of 1,500 to 9,000) and low molecular weight polyethylene. Examples of releasing agents include ester waxes such as an ester of a higher fatty acid and a long chain alcohol and an ester of a higher fatty acid and polyhydric alcohol, carnauba was and candelilla wax.

A preferred releasing agent is an ester wax compound represented by the following formula:

$$R^1—(OCO—R^2)_n$$

wherein n is an integer of 1 to 4 (preferably 2 to 4, more preferably 3 or 4 and still more preferably 4); $R^1$ and $R^2$ are each a hydrocarbon group, which may be substituted. $R_1$ has 1 to 40 carbon atoms (preferably 1 to 20, and more preferably 2 to 5 carbon atoms); $R_2$ has 1 to 40 carbon atoms (preferably 16 to 30, and more preferably 18 to 26 carbon atoms).

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{22}—CH_3$

7) $CH_3—(CH_2)_{22}—COO—(CH_2)_2—CH(CH_3)—CH_2—O—CO—(CH_2)_{22}—CH_3$ $CH_3—(CH_2)_{22}—COO—CH_2—CH(CH_3)—CH_2—O—CO—(CH_2)_{22}—CH_3$

-continued

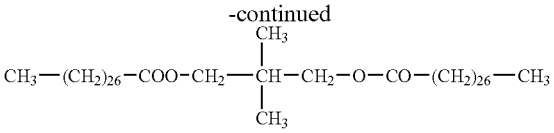

10)

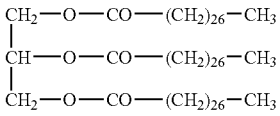

11)

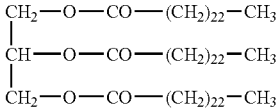

12)

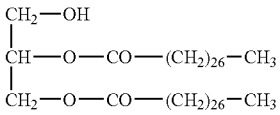

13)

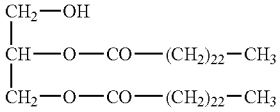

14)

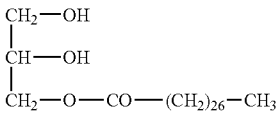

15)

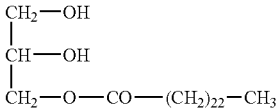

16)

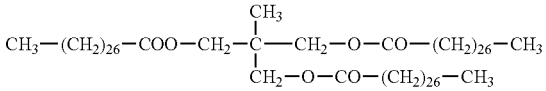

17)

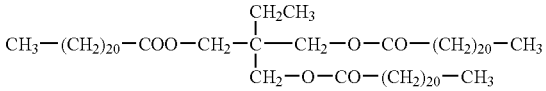

18)

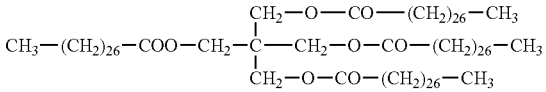

19)

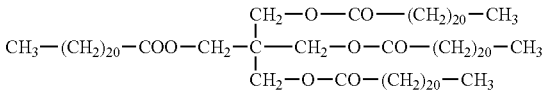

20)

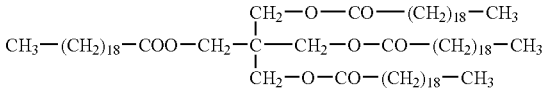

21)

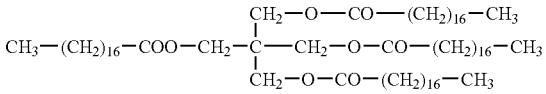

The foregoing releasing agent is added preferably in an amount of 1 to 30%, more preferably 2 to 20%, and still more preferably 3 to 15% by weight, based on the whole toner.

The reason for the preferred use of ester type waxes is effective for improvement in transfer as well as an effect on fixing. Although the reason is not clarified, it is assumed that a minute amount of such a wax is transferred from the toner surface to the photoreceptor during development or cleaning, thereby lowering the surface energy of the receptor and leading to improvement in transfer.

Methods for adding a releasing agent into a toner are not specifically limited and examples thereof include a method in which similarly to colorant particles, a releasing agent is allowed to be flocculated/fused together with resin particles and a method in which a fixation-improving agent is dissolved in a monomer to form resin particles and caused to polymerize to prepare resin particles.

Employed as charge control agents may also be various types of those which are known in the art and can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof.

Incidentally, it is preferable that the number average primary particle diameter of particles of the charge control agents as well as the fixability improving agents is adjusted to about 10 to about 500 nm in the dispersed state.

Further, the toner of the present invention is capable of exhibiting more desired effects when employed after adding fine particles such as fine inorganic or fine organic particles, as external additives. The reason is understood to be as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of the hydrophobic treatment is not particularly limited, but the degree is preferably between 40 and 95 in terms of the methanol wettability. The methanol wettability, as described herein, refers to wettability for methanol. The methanol wettability is determined as follows: in a beaker having an inner capacity of 200 ml, 0.2 g of fine inorganic particles to be measured is weighed and added to 50 ml of distilled water. Methanol is then gradually dripped, while stirring, from a burette whose outlet is immersed in the liquid, until the entire fine inorganic particles are wetted. When the volume of methanol, which is necessary to completely wet the fine inorganic particles, is represented by "a" ml, the degree of hydrophobicity is calculated based on the formula described below:

$$\text{Degree of hydrophobicity}=[a/(a+50)]\times 100$$

The added amount of the external additives is generally from 0.1 and 5.0 percent by weight with respect to the toner, and is preferably from 0.5 to 4.0 percent. Further, external additives may be employed in combinations of various types.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of the medium in the reaction vessel. Namely, when toner particles, which have a shape factor of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape factor of not more than 1.2, are formed, employed as the flow of the medium in the reaction vessel is a laminar flow. Spherical particles are obtained by minimizing collisions among the particles. By employing the methods, it is possible to control the distribution of shaped toner particles within the intended range.

FIG. 1 is an explanatory view showing a commonly employed reaction apparatus (a stirring apparatus) in which stirring blades are installed at one level, wherein reference numeral 2 is a stirring tank, 3 is a rotation shaft, 4 are stirring blades, and 9 is a turbulent flow forming member.

In the suspension polymerization method, it is possible to form a turbulent flow employing specified stirring blades and to readily control the resultant shape of particles. The reason for this phenomenon is not yet clearly understood. When stirring blades 4 are positioned at one level, as shown in FIG. 1, the medium in stirring tank 2 flows only from the bottom part to the upper part along the wall. Due to that, a conventional turbulent flow is commonly formed and stirring efficiency is enhanced by installing turbulent flow forming member 9 on the interior wall surface of stirring tank 2. Though in the stirring apparatus, the turbulent flow is locally formed, the presence of the formed turbulent flow tends to retard the flow of the medium. As a result, shearing against particles decreases to make it almost impossible to control the shape of resultant particles.

Reaction apparatuses provided with stirring blades, which are preferably employed in a suspension polymerization method, will now be described, with reference to the drawings.

Figure 2:
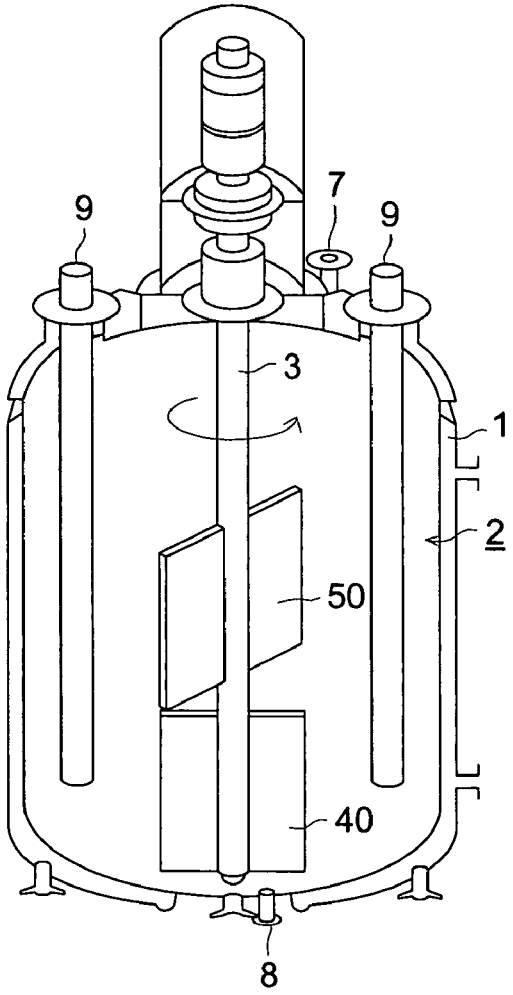
FIGS. 2 and 3 are respectively perspective views and cross-sectional views of a reaction apparatus.
Figure 3:
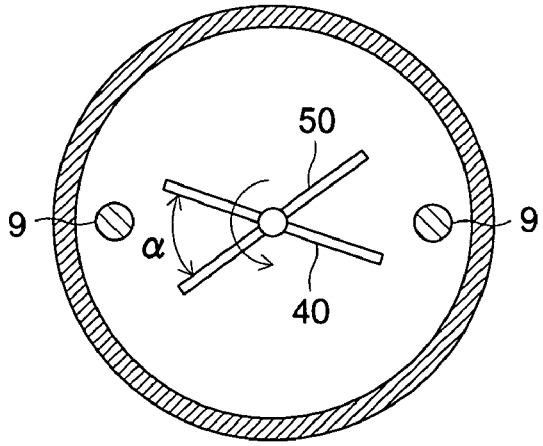

FIGS. 2 and 3 each are respectively perspective views and cross-sectional views, of the reaction apparatus described above. In the reaction apparatus illustrated in FIGS. 2 and 3, rotating shaft 3 is installed vertically at the center in vertical type cylindrical stirring tank 2 of which exterior circumference is equipped with a heat exchange jacket, and the rotating shaft 3 is provided with lower level stirring blades 40 installed near the bottom surface of the stirring tank 40 and upper level stirring blade 50. Upper level stirring blades 50 are arranged with respect to the lower level stirring blade so as to have a crossed axis angle $\alpha$ advanced in the rotation direction. When the toner of the presents invention is prepared, the crossed axis angle $\alpha$ is preferably less than 90 degrees. The lower limit of the crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by the stirring blades 50 themselves, and as a whole, accelerating the flow. As a result, it is further assumed that since a flow area is formed which has large shearing stress in the turbulent flow, it is possible to control the shape of the resultant toner.

Incidentally, in FIGS. 2 and 3, arrows show the rotation direction, reference numeral 7 is upper material charging inlet, 8 is a lower material charging inlet, and 9 is a turbulent flow forming member which makes stirring more effective.

Herein, the shape of the stirring blades is not particularly limited, but employed may be those which are in a square plate shape, blades in which a part is cut away, blades having at least one opening in the central area, a so-called slit, and the like. FIGS. 10(*a*) through 10(*d*) describe specific examples of the shape of the blades. Stirring blade 5*a* shown in FIG. 10(*a*) has no central opening; stirring blade 5*b* shown in FIG. 10(*b*) has large central opening areas 6*b;* stirring blade 5*c* shown in FIG. 10(*c*) has rectangular openings 6*c* (slits); and stirring blade 5*d* shown in FIG. 10(*d*) has oblong openings 6*d* (slits) shown. Further, when stirring blades of a three-level structure are installed, openings which are formed at the upper level stirring blade and the openings which are installed in the lower level may be different or the same.

FIGS. 4 through 8 each shows a perspective view of a specific example of a reaction apparatus fitted with stirring blades which may be preferably employed. In FIGS. 4 through 8, reference numeral 1 is a heat exchange jacket, 2 is a stirring tank, 3 is a rotation shaft, 7 is an upper material charging inlet, 8 is a lower material charging inlet, and 9 is a turbulent flow forming member.

Figure 4:
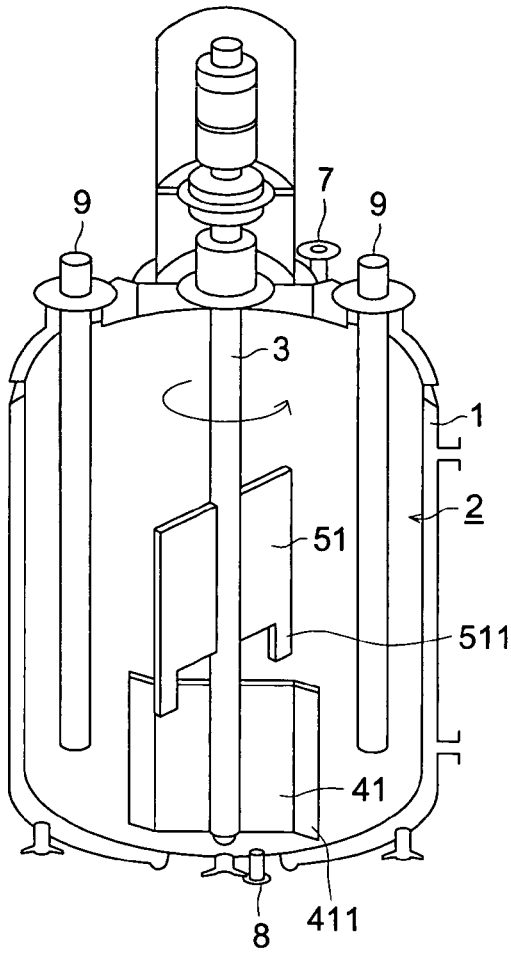
FIGS. 4 through 9 each shows a perspective view of a specific example of a reaction apparatus fitted with stirring blades.

In the reaction apparatus shown in FIG. 4, folded parts 411 are formed on stirring blade 41 and fins 511 (projections) are formed on stirring blade 51.

Further, when the folded sections are formed, the folded angle is preferably between 5 and 45 degrees.

Figure 5:
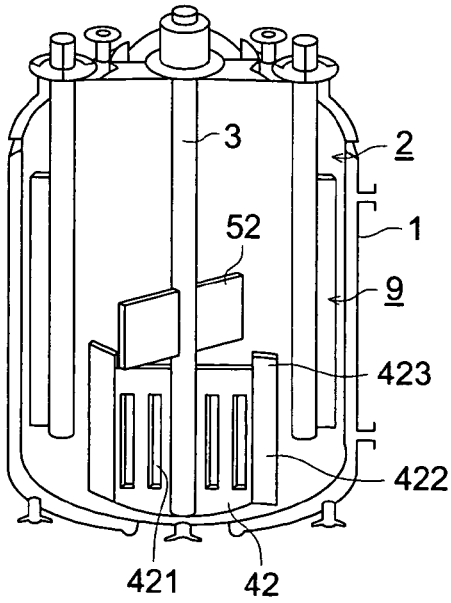

In stirring blade 42, which constitutes the reaction apparatus shown in FIG. 5, slits 421, folded sections 422, and fins 423 are formed concurrently.

Further, stirring blade 52, which constitutes part of the reaction apparatus, has the same shape as stirring blade 50 which constitutes part of the reaction apparatus shown in FIG. 2.

Figure 6:
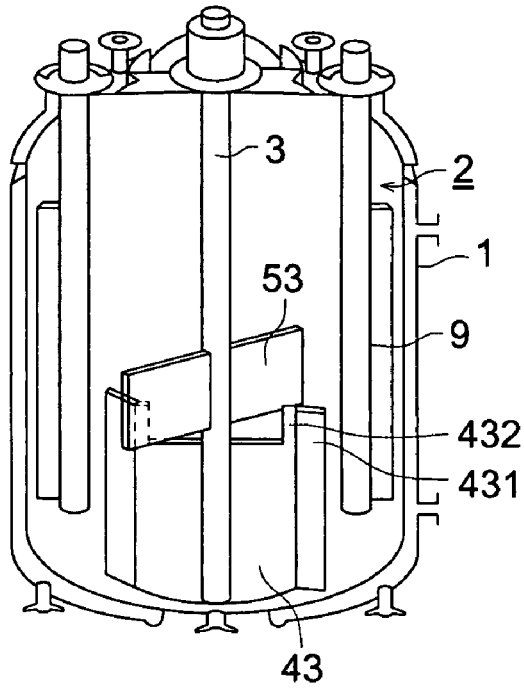

In stirring blade 43, which constitutes part of the reaction apparatus shown in FIG. 6, folded section 431 as well as fin 432 is formed.

Further, stirring blade 53, which constitutes part of the reaction apparatus, has the same shape as stirring blade 50 which constitutes a part of the reaction apparatus shown in FIG. 2.

Figure 7:
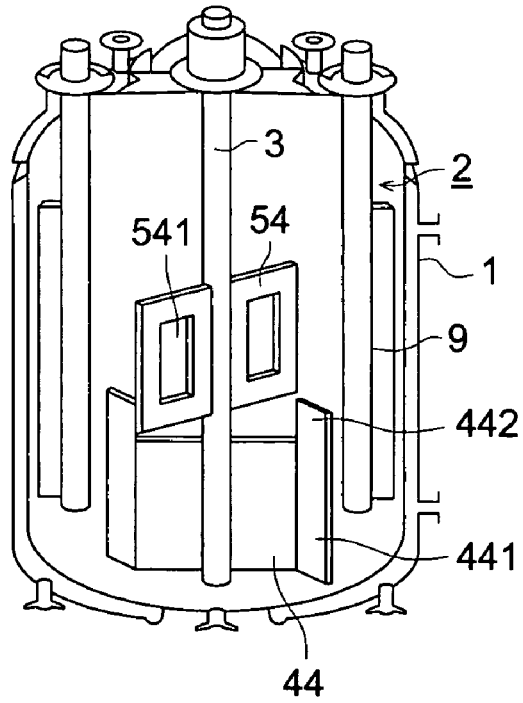

In stirring blade 44, which constitutes part of the reaction apparatus shown in FIG. 7, folded section 441 as well as fin 442 is formed. Further, in stirring blade 54, which constitutes part of the reaction apparatus, openings 541 are formed in the center of the blade.

Figure 8:
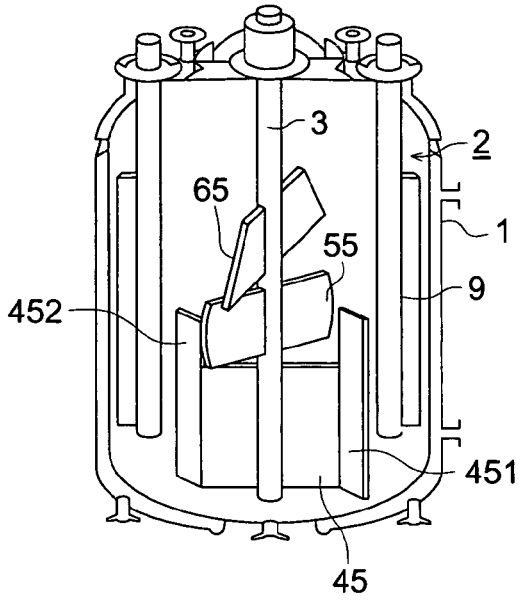

In the reaction apparatus shown in FIG. 8, provided are three-level stirring blades comprised of stirring blade 45 (at the lower level), stirring blade 55 (at the middle level), and stirring blades 65 at the top.

Stirring blades having such folded sections (451), stirring blades which have upward and downward projections (fins, 452), all generate an effective turbulent flow.

Still further, the distance between the upper and the lower stirring blades is not particularly limited, but it is preferable that such a distance is provided between stirring blades. The specific reason is not clearly understood. It is assumed that a flow of the medium is formed through the space, whereby the stirring efficiency is improved. However, the space is generally in the range of 0.5% to 50% with respect to the height of the liquid surface in a stationary state, and is preferably in the range of 1% to 30%.

Further, the size of the stirring blade is not particularly limited, but the sum of the height of all stirring blades is between 50% and 100% with respect to the liquid height in the stationary state, and is preferably between 60% and 95%.

Figure 9:
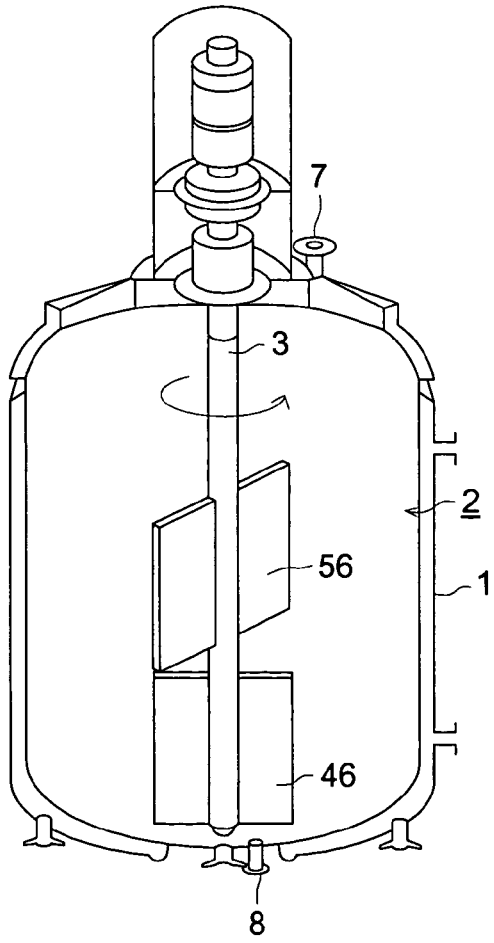

Furthermore, FIG. 9 shows one example of a reaction apparatus employed when a laminar flow is formed in the suspension polymerization method. The reaction apparatus is characterized in that no turbulent flow forming member (obstacles such as a baffle plate) is provided.

Stirring blade 46, as well as stirring blade 56, which constitutes the reaction apparatus shown in FIG. 9, has the same shape as well as the crossed axis angle $\alpha$ of stirring blade 40, as well as stirring blade 50 which constitutes part of the reaction apparatus shown in FIG. 2. In FIG. 9, reference numeral 1 is a heat exchange jacket, 2 is a stirring tank, 3 is a rotation shaft, 7 is an upper material charging inlet, and 8 is a lower material charging inlet.

Incidentally, apparatuses, which are employed to form a laminar flow, are not limited to the ones shown in FIG. 9.

Further, the shape of the stirring blades, which constitute part of the reaction apparatuses, is not particularly limited as long as they do not form a turbulent flow, but rectangular plates which are formed of a continuous plane are preferred, and may have a curved plane.

On the other hand, in toner which is prepared employing the polymerization method in which resin particles are coagulated or fused in a water based medium, it is possible to optionally vary the shape distribution of all the toner particles, as well as the shape of the toner particles, by controlling the flow of the medium and the temperature distribution during the fusion process in the reaction vessel, and by further controlling the heating temperature, the frequency of rotation of stirring, as well as the time during the shape controlling process after fusion.

Namely, in a toner which is prepared employing the polymerization method in which resin particles are coagulated or fused, it is possible to form toner which has the specified shape factor and uniform distribution by controlling the temperature, the frequency of rotation, and the time during the fusion process, as well as the shape controlling process, employing the stirring blade and the stirring tank which are capable of forming a laminar flow in the reaction vessel, as well as forming the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resin particles are coagulated or fused, can be the same stirring blades and stirring tank which are employed in the suspension polymerization in which the laminar flow is formed, and for example, it is possible to employ the apparatus shown in FIG. 9. The apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle a in advance in the rotation direction with respect to the lower stirring blade.

Employed as the stirring blades may be the same blades which are used to form a laminar flow in the aforesaid suspension polymerization method. Stirring blade types are not particularly limited as long as a turbulent flow is not formed, but those comprised of a rectangular plate as shown in FIG. 10(*a*), which are formed of a continuous flat plane are preferable, and those having a curved plane may also be employed.

Image forming methods are not specifically limited, and include, for example, a system in which plural images are formed on a photoreceptor and transferred together, and a system in which images formed on the photoreceptor are successively transferred onto a transfer belt.

Of the foregoing, the system in which plural images are formed on the photoreceptor and transferred together is preferred, whereby the effects become marked. Although the reason therefor is not clarified, it is assumed that when a large amount of a toner is transferred, ultrasonic vibration comes into effect, resulting in more uniform transfer and thereby leading to enhanced color reproducibility and improved gradation.

In this system, a photoreceptor is uniformly charged and exposed corresponding to the first image, followed by a first development to form the first image on the photoreceptor. Subsequently, the photoreceptor which has formed the first image, is uniformly charged and exposed corresponding to a second image, followed by the second development to form the second image on the photoreceptor. Further, the photoreceptor which has formed the first and second images, is uniformly charged and exposed corresponding to a third image, followed by the third development to form the third image on the photoreceptor. Furthermore, the photoreceptor which has formed the first, second and third images, is uniformly charged and exposed corresponding to a fourth image, followed by the fourth development to form the fourth image on the photoreceptor. For example, the first development forms a yellow image, the second development forms a magenta image, the third development forms a cyan image and the fourth development forms a black image.

Thereafter, the images formed on the photoreceptor are all transferred together onto an image support such as paper or the like and fixed to form an image.

In this system, the images formed on the photoreceptor are transferred all together onto an image support such as paper to form images so that differing from a so-called intermediate transfer system, the image transfer often causing disorder of images is completed by only one transfer, thereby rendering it possible to enhance image quality.

As a system for performing development on the photoreceptor, a non-contact development is preferred since plural developments are required. A system in which an alternating electric field is applied in development is also preferred.

In the image forming method, an image forming body having a toner image on the surface thereof is transported to the prescribed transfer region and a given image supporting body is overlapped onto the image forming body so that the toner image is sandwiched between the image supporting body and the image forming body; then, a given ultrasonic wave is applied onto the image forming body and the image supporting body sandwiching the toner image from an ultrasonic radiation means which is arranged at the position facing the image forming body and image supporting body with maintaining non-contact with applying an electric field between the image forming body and the image supporting body, whereby the toner image is transferred onto the image supporting body and then, the transferred toner image is finally fixed to form the image.

One feature of the foregoing is that the ultrasonic radiation means is arranged with maintaining the ultrasonic radiation plane radiating an ultrasonic wave parallel to the plane of the image forming body or image supporting body which faces the ultrasonic radiation plane and at a position apart at a distance between the ultrasonic radiation plane and the plane facing thereto, of an integral factor of half of the ultrasonic wavelength, and the ultrasonic wave is thus radiated from the ultrasonic radiation means toward the plane facing thereto.

Herein, it is preferred that the ultrasonic radiation means is arranged downstream of the transporting direction of the toner image on the image forming body from and adjacent to the means for applying an electric field.

It is also preferred to install a means for preventing vibration propagation either upstream or downstream and/or both in the direction of transporting the toner image on the image forming body to prevent vibration which is to be provided to the image forming body and the image supporting body by an ultrasonic radiation means, from propagating to the region other than the transfer region.

Figure 12:
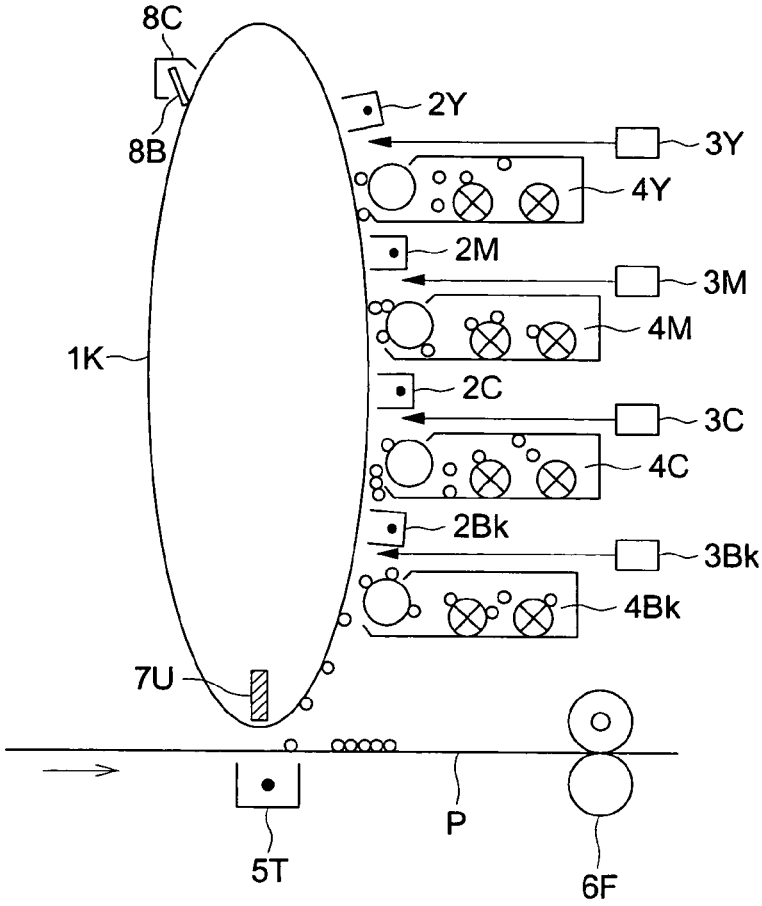
FIG. 12 illustrates a section of a full color imaging apparatus.

FIG. 12 illustrates a section of a full color imaging apparatus relating to this invention. Uniform charging devices (hereinafter, also denoted as chargers) 2Y, 2M, 2C and 2B for the respective colors, yellow (Y), magenta (M), cyan (C) and black (Bk) are arranged side by side around a belt photoreceptor (1K). There are also arranged side by side image exposure devices 3Y, 3M, 3C and 3Bk for the respective colors, yellow (Y), magenta (M), cyan (C) and black (Bk), as shown in FIG. 12.

Using uniform charge 2Y, image exposure device 3Y and developing device 4Y which are adjacently placed, a yellow unit image is formed on the belt photoreceptor (1K). In a manner similar to a monochromatic image forming apparatus, the overall surface of the belt photoreceptor is uniformly charged by uniform charger 2Y and then imagewise exposed by image exposure device 3Y, followed by development using developing device 4Y loaded with a yellow toner to form the yellow image.

The belt photoreceptor (1K) is then rotationally displaced and timing thereto, image formation for each of magenta, cyan and black is also performed on the same region of the photoreceptor to form a full color image composed of the respective superposed unit color images.

When the belt photoreceptor is further rotationally displaced and reaches the position of transfer device 5T and ultrasonic device 7U, the full color image is transferred onto a timely transported image supporting body (P)(hereinafter, also denoted as image support) and the image support having the full color toner image is further transported toward fixing device 6F to fix the color image on the image support.

After transferring the toner image, the belt photoreceptor is further rotationally displaced to remove any remaining toner and paper dust on the surface of the photoreceptor by cleaning device 8C (cleaning blade 8B) and is usually ready for another cycle.

The use of conventional toners exhibiting a broad distribution of particle size or shape often causes mixing of colors, resulting in inferior image formation. As described above, the toner of this invention is uniform in particle size or shape and comprised of toner particles having no corners, resulting in a reduced difference in charging amount or adhesion force among toner particles and no occurrence of mixing of colors and bringing out the advantage of a package transfer system, such as less frequencies of transfer and minimized disorder of images, thereby forming superior images.

To constitute an image forming apparatus, as shown in FIG. 12, the photoreceptor preferably is in the form of a belt.

The toner relating to the image forming method of this invention may be used as a single-component magnetic toner containing magnetic material, as a two-component developer mixed with a so-called carrier or as a single non-magnetic toner, and the use of a two-component developer mixed with a carrier is preferred.

Figure 13:
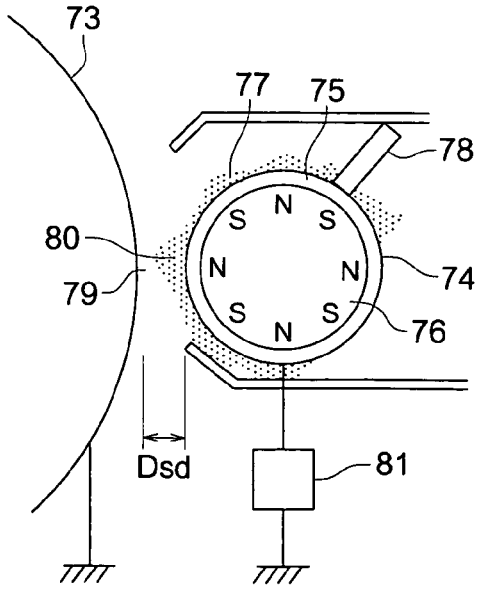
FIG. 13 illustrates the main part of a development device, of a non-contact development system.

As a development system in which superposed color images are formed on an image forming body and transferred altogether, as described above, a non-contact development system is preferred. A diagram of a representative development apparatus of such a development system is shown in FIG. 13. Thus, FIG. 13 illustrates the main part of a development device of a non-contact development system usable in the image forming method of this invention, in which the numeral 73 designates a photoreceptor; 74, a developer bearing body; 75, a sleeve; 76, a magnet; 77, a two-component developer containing the toner relating to this invention; 78, a developer layer-controlling member; 79, a developing region; 80, a developer layer; and 81, an alternating electric field.

The two-component developer (77) containing the toner of this invention is carried by a magnetic force of the developer bearing body (74) internally containing the magnet (77) and transported by displacement of the sleeve (75). The thickness of the developer layer (80) is controlled by the developer layer-controlling member (78) so that the developer layer is not brought into contact with the photoreceptor (73) during transport.

The minimum spacing (Dsd) in the developing region (79) is greater than the thickness of the transferred developer layer (80), which is preferably a thickness of 50 to 300 μm. For example, the Dsd is about 100 to 1000 μm (preferably 100 to 500 μm).

Power source (81) forms an alternating electric field, of which an alternating current of 200 to 8000 Hz and 500 to 3000 Vp-p is preferable. The power source (81) may be constituted by optionally adding a direct current to the alternating current in series, in which the direct current voltage preferably is 300 to 800 V.

The volume-average particle size of a carrier used in the two-component developer is 15 to 100 μm and preferably 25 to 60 μm. The volume-average particle size can be determined, for example, using a laser diffraction type particle size distribution measurement apparatus installed with a wet dispersing machine, "HELOS" (available from SYMPATEC Co.).

Preferred carriers include, for example, a resin-coated carrier and a so-called resin dispersion type carrier in which magnetic particles are dispersed in resin. The resin composition used for coating is not specifically limited and examples thereof include an olefin type resin, a styrene type resin, a styrene/acryl type resin, a silicone type resin, an ester type resin and a fluorinated polymer type resin. Resins used for the resin dispersion type carrier are not specifically limited and commonly known resins are usable. Examples thereof include a styrene/acryl resin, a polyester resin, a fluorinated resin and a phenol resin.

Suitable fixing methods usable in this invention include a so-called contact heating system. Specific examples of the contact heating system include a heated roller fixing system and a pressure heat-fixing system in which a rotary heating member including a fixed heating body is used for fixing.

EXAMPLES

The present invention will be further described based on specific examples of the embodiment but is by no means limited to these.

Toner Preparation (1)

Black toners were prepared by the process of emulsion polymerization and fusion according to the following procedure. Nonylphenolpolyethylene oxide 10 mole addition product of 0.50 kg was added into 10.0 liter of pure water and dissolved with stirring. To the resulting solution was gradually added 1.20 kg of Regal 330R (carbon black manufactured by Cabot Corp.). The resulting mixture was well stirred for one hour, and thereafter, was continuously dispersed for 20 hours employing a sand grinder (a medium type homogenizer). The obtained dispersion was designated "colorant dispersion 1".

Further, a solution comprised of 0.055 kg of nonylphenolpolyethylene oxide 10 mole addition product and 4.0 liter of deionized water was designated "nonionic surfactant solution A". A solution comprised of 0.014 kg of nonylphenolpolyethylene oxide 10 mole addition product and 4.0 liter of deionized water was designated "nonionic surfactant solution B". A solution comprised of 238 g of potassium persulfate dissolved in 12.0 liter of deionized water was designated "initiator solution C".

Into a 100 liter GL (glass lined) reaction vessel fitted with a temperature sensor, a condenser and a nitrogen introducing device were added with stirring the total amount of nonionic surfactant solution A and the total amount of nonionic surfactant solution B. Subsequently, 44.0 liter of deionized water was added.

When the resulting mixture reached 75° C., the total amount of initiator solution C was added thereto. Then, while maintaining the resulting mixture at 75±1° C., a mixture consisting of 12.1 kg of styrene, 2.70 kg of n-butyl acrylate, 1.14 kg of methacrylic acid, and 550 g of t-dodecylmercaptan was added dropwise. After completing the addition, the resulting mixture was heated to 80±1° C. and stirred for 6 hours while maintaining the temperature. Subsequently, the temperature was lowered to 40° C. or less and stirring was stopped. The resulting products were filtered employing a pole filter and the resulting filtrate was designated as "latex-A".

It was proved that the resin particles in the latex-A exhibited a glass transition temperature of 58° C. and a softening point of 119° C., and the molecular weight distribution of a weight average molecular weight of 13,500 and a weight average particle diameter of 115 nm.

Further, a solution prepared by dissolving 0.055 kg of sodium dodecylbenzenesulfonate in 4.0 liter of deionized water was designated "anionic surfactant solution D". Further, a solution prepared by dissolving 0.014 kq of a nonylphenolpolyethylene oxide 10 mole addition product in 4.0 liter of deionized water was designated "nonionic surfactant solution E".

A solution prepared by dissolving 200.7 g of potassium persulfate (manufactured by Kanto Kagaku Co.) in 12.0 liter of deionized water was designated "initiator solution F".

Into a 100 liter GL reaction vessel, fitted with a thermal sensor, a condenser, a nitrogen introducing device, and a comb-shaped baffle, were added 3.41 kg of WAX emulsion (polypropylene emulsion having a number average molecular weight of 3,000, a number average primary particle diameter of 120 nm, and 29.9% solid), the total amount of anionic Surface Active Agent D", and the total amount of nonionic surfactant solution E, and the resulting mixture was stirred. Subsequently, 44.0 liter of deionized water were added. When the resulting mixture was heated and reached 70° C., initiator solution F was added. Subsequently, a solution previously prepared by mixing 11.0 kg of styrene, 4.00 kg of n-butyl acrylate, 1.04 kg of methacrylic acid, and 9.0 g of t-dodecylmercaptan was added dropwise. After completing the dropwise addition, the resulting mixture was maintained at 72 ±2° C. and stirred for 6 hours while maintaining the temperature. Subsequently, the temperature was raised to 80±2° C., and stirring was carried out for 12 more hours while controlling the temperature within the range. The temperature was then lowered to n 40° C. or less, and stirring was terminated. The resulting products were filtered employing a pole filter and the resulting filtrate was designated as "latex-B".

It was proved that the resin particles in the latex-B exhibited a glass transition temperature of 58° C. and a softening point of 132° C., a weight average molecular weight of 245,000 regarding the molecular weight distribution, and a weight average particle diameter of 110 nm.

A solution prepared by dissolving 5.36 g of sodium chloride as the salting-out agent in 20.0 liter of deionized water was designated "sodium chloride solution G".

A solution prepared by dissolving 1.00 g of a fluorine based nonionic surface active agent in 1.00 L of deionized water was designated as "Nonionic Surface Active Agent Solution H".

To a 100 liter SUS reaction vessel (the reaction apparatus constituted as shown in FIG. 9, having a crossed axes angle α of 25 degrees), fitted with a temperature sensor, a condenser, a nitrogen introducing device, a particle diameter and shape monitoring unit were added 20.0 kg of latex-A and 5.2 kg of latex-B as prepared above, 0.4 kg of colorant dispersion 1, and 20.0 kg of deionized water, and the resulting mixture was stirred. Subsequently, the mixture was heated to 40° C., and sodium chloride solution G and 6.00 kg of isopropanol (manufactured by Kanto Kagaku Co.), and nonionic surfactant solution H were added in that order. Thereafter, the resulting-mixture was allowed to stand for 10 minutes, and then heated to 85° C. over a period of 60 minutes. While being heated at 85±2° C. for the period of from 0.5 to 3 hours with stirring, the mixture was subjected to flocculation/fusion so that the particle diameter increased. Subsequently, the increase in the particle diameter was stopped by the addition of 2.1 L of pure water.

Into a 5 liter reaction vessel (the reaction apparatus constituted as shown in FIG. 9, having a crossed axes angle α of 20 degrees), fitted with a temperature sensor, a condenser, and a particle diameter and shape monitoring unit, were added 5.0 kg of the fused particle dispersion as prepared above, and the dispersion was heated with stirring at 85±2° C. for a period of 0.5 to 15 hours so as to control the particle shape. Thereafter, the resulting dispersion was cooled to 40° C. or less and stirring was stopped. Subsequently, employing a centrifugal separator, classification was carried out in a liquid medium utilizing a centrifugal sedimentation method, and filtration was carried out employing a Nutsche funnel. Subsequently, wet cake-like non-spherical particles were collected and then washed with deionized water. The resulting non-spherical particles were dried at an air intake temperature of 60° C., employing a flash jet dryer, and subsequently dried at 60° C. employing a fluidized layer dryer. To 100 parts by weight of the obtained colored particles was externally added 1 part by weight of fine silica particles and the resulting mixture was blended employing a Henschel mixer, whereby a black toner was obtained which were prepared employing the emulsion polymerization fusion method.

Black toners Bk-1 to Bk-5, which were each comprised of toner particles exhibiting specified shape characteristics and particle size distribution characteristics, were obtained by controlling the shape and the coefficient of variation of the shape factor through controlling the rotation speed of the stirrer as well as the heating time during the flocculation/ fusion stage and the monitoring of the shape controlling process, and further regulating the particle diameter and the variation coefficient of the size distribution.

Toner Preparation (2)

Similarly to the foregoing toner preparation (1), yellow toners Y-1 to Y-5, exhibiting specified shape and particle size distribution, were prepared through emulsion polymerization and fusion, except that colorant carbon black was replaced by 1.05 kg of yellow pigment C.I. Pigment Yellow 93.

Toner Preparation (3)

Similarly to the foregoing toner preparation (1), magenta toners M-1 to M-5, exhibiting specified shape and particle size distribution, were prepared through emulsion polymerization and fusion, except that colorant carbon black was replaced by 1.20 kg of rhodamine type magenta pigment (C.I. Pigment Red 122).

Toner Preparation (4)

Similarly to the foregoing toner preparation (1), cyan toners C-1 to C-5, exhibiting specified shape and particle size distribution, were prepared through emulsion polymerization and fusion, except that colorant carbon black was replaced by 0.60 kg of phthalocyanine type cyan pigment (C.I. Pigment Blue 15:3).

Toner Preparation (5)

A toner was prepared through suspension polymerization in the following manner. Thus, a mixture consisting of 165 g of styrene, 35 g of n-butyl acrylate, 10 g of-carbon black, 20 g of ester compound 19 and 8 g of a styrene-methacrylic acid copolymer was heated to 60° C., and uniformly dissolve-dispersed at 12,000 rpm employing a TK Homomixer (Tokushukika Kogyo Co.). To the resulting dispersion was added 10 g of 2,2'-azobis(2,4-valeronitile) as the polymerization initiator and dissolved to prepare a polymerizable monomer composition. Subsequently, 450 g of 0.1 M sodium phosphate was added to 710 g of deionized water, and 68 g of 1.0 M calcium chloride was gradually added while stirring at 13,000 rpm employing a TK Homomixer, whereby a dispersion, in which tricalcium phosphate was dispersed, was prepared. The polymerizable monomer composition was added to the dispersion and stirred at 10,000 rpm for 20 minutes employing a TK Homomixer, whereby the polymerizable monomer composition was granulated. Thereafter, the resulting composition underwent reaction at a temperature of 75 to 95° C. for a period of 5 to 15 hours, employing a reaction apparatus (having a crossed axes angle α of 45 degrees) in which stirring blades were constituted as shown in FIG. 7. Tricalcium phosphate was dissolved employing hydrochloric acid and then removed. Subsequently, while employing a centrifuge, classification was carried out in a liquid medium, utilizing a centrifugal sedimentation method. Thereafter, filtration, washing and drying were carried out. To 100 parts by weight of the obtained colored particles were externally added 1.0 part by weight of fine silica particles, and the resulting mixture was blended employing a Henschel mixer, whereby a toner was obtained which was prepared employing the suspension polymerization process.

Black toners Bk-6 to Bk-8, exhibiting specified particle shape and particle size distribution, were obtained by controlling the shape as well as the variation coefficient of the shape factor through controlling the temperature of the liquid medium, the rotation frequency of the stirrer, and the heating duration while carrying out monitoring during the polymerization, and further by regulating the particle diameter as well as the variation coefficient of the size distribution.

Toner Preparation (6)

Similarly to the foregoing toner preparation (5), yellow toners Y-6 to Y-8, exhibiting specified shapes and particle size distributions, were prepared through suspension polymerization, except that colorant carbon black was replaced by 10 g of yellow pigment C.I. Pigment Yellow 93.

Toner Preparation (7)

Similarly to the foregoing toner preparation (5), magenta toners M-6 to M-8, exhibiting specified shapes and particle size distributions, were prepared through suspension polymerization, except that colorant carbon black was replaced by 10 g of quinacridone type magenta pigment (C.I. Pigment 122).

Toner Preparation (8)

Similarly to the foregoing toner preparation (5), cyan toners C-6 to C-8, exhibiting specified shapes and particle size distributions, were prepared through suspension polymerization, except that colorant carbon black was replaced by 10 g of phthalocyanine type cyan pigment (C.I. Pigment Blue 15:3).

Toner Preparation (9)

Similarly to the foregoing toner preparation (5), black toner Bk-9, exhibiting specified shape and particle size distribution, was prepared through suspension polymerization, except that the reaction apparatus (exhibiting a crossing angle α of 15 degree), as shown in FIG. 9 and classification was not carried out in a liquid medium, utilizing a centrifugal sedimentation method.

Toner Preparation (10)

Similarly to the foregoing toner preparation (9), yellow toner Y-9, exhibiting specified shape and particle size distribution, was prepared through suspension polymerization, except that colorant carbon black was replaced by 10 g of yellow pigment C.I. Pigment Yellow 93.

Toner Preparation (11)

Similarly to the foregoing toner preparation (9), magenta toner M-9, exhibiting specified shape and particle size distribution, was prepared through suspension polymerization, except that colorant carbon black was replaced by 10 g of magenta pigment Carmine 6B.

Toner Preparation (12)

Similarly to the foregoing toner preparation (9), cyan toner C-9, exhibiting specified shape and particle size distribution, was prepared through suspension polymerization, except that colorant carbon black was replaced by 10 g of phthalocyanine cyan pigment (C.I. Pigment Blue 15:3).

Toner Preparation (13)

Toners were prepared by the pulverization process, according to the following procedure. Thus, toner raw material of 100 kg of styrene-n-butyl acrylate copolymer resin, 10 kg of carbon black and 4 kg of polypropylene were preliminarily mixed using a Henschel mixer, fused and kneaded using a twin-screw extruder, coarsely ground using a hammer mill, and pulverized using a jet pulverizer. The thus prepared powder was dispersed in a hot air stream of a spray drier (0.05 sec. at 200 to 300° C.) to obtain particles adjusted in shape. The particles were repeatedly classified using a wind power classifier until reached the intended particle size distribution. To 100 parts by weight of the thus obtained color particles, 1 part by weight of silica particles was externally added and mixed using a Henschel mixer to obtain a toner prepared by the pulverization process (hereinafter, also denoted simply as pulverization toner).

Thus, black toners Bk-10 and Bk-11, exhibiting specified shape characteristics and particle size distribution characteristics were obtained by controlling the particle shape and the coefficient of variation of the shape factor and adjusting the particle size and the coefficient of particle size distribution.

Toner Preparation (14)

Similarly to the foregoing toner preparation (13), yellow toners Y-10 and Y-11, exhibiting specified shape and particle size distribution, were prepared by the pulverization process, except that colorant carbon black was replaced by 4 kg of yellow pigment C.I. Pigment Yellow 17.

Toner Preparation (15)

Similarly to the foregoing toner preparation (13), magenta toners M-10 and M-11, exhibiting specified shape and particle size distribution, were prepared by the pulverization process, except that colorant carbon black was replaced by 4 kg of a quinacridone type magenta pigment (C.I. Pigment Red 122).

Toner Preparation (16)

Similarly to the foregoing toner preparation (13), cyan toners C-10 and C-11, exhibiting specified shape and particle size distribution, were prepared by the pulverization process, except that colorant carbon black was replaced by 4 kg of a phthalocyanine type cyan pigment (C.I. Pigment Blue 15:3).

Characteristics of the thus prepared toners are shown in Table 1.

TABLE 1

| Toner No. | Shape Factor | C.V. −1*1 (%) | Proportion 1*2 (%) | Proportion 2*3 (%) | Particle Size*4 (μm) | M = m1 + m2*5 | C.V. 2 (%) |
|---|---|---|---|---|---|---|---|
| Bk-1 | 1.54 | 13 | 8 | 85 | 5.3 | 72 | 25 |
| Y-1 | 1.46 | 14 | 82 | 82 | 5.2 | 74 | 24 |
| M-1 | 1.48 | 12 | 89 | 83 | 5.4 | 78 | 25 |
| C-1 | 1.49 | 11 | 88 | 87 | 5.3 | 72 | 23 |
| Bk-2 | 1.47 | 11 | 88 | 88 | 5.9 | 76 | 21 |
| Y-2 | 1.43 | 12 | 88 | 88 | 5.9 | 78 | 20 |
| M-2 | 1.44 | 13 | 89 | 89 | 5.8 | 75 | 21 |
| C-2 | 1.41 | 10 | 90 | 88 | 5.9 | 75 | 21 |
| Bk-3 | 1.37 | 14 | 79 | 78 | 5.2 | 72 | 23 |
| Y-3 | 1.33 | 14 | 78 | 78 | 5.1 | 71 | 21 |
| M-3 | 1.34 | 13 | 79 | 79 | 5.0 | 74 | 22 |
| C-3 | 1.31 | 13 | 78 | 78 | 5.3 | 73 | 23 |
| Bk-4 | 1.27 | 11 | 89 | 93 | 5.4 | 75 | 22 |
| Y-4 | 1.29 | 11 | 87 | 92 | 5.7 | 75 | 21 |
| M-4 | 1.28 | 12 | 89 | 91 | 5.5 | 76 | 21 |
| C-4 | 1.28 | 11 | 88 | 93 | 5.5 | 76 | 20 |
| Bk-5 | 1.10 | 10 | 59 | 94 | 5.3 | 62 | 32 |
| Y-5 | 1.15 | 12 | 57 | 97 | 5.3 | 62 | 32 |
| M-5 | 1.12 | 11 | 58 | 98 | 5.5 | 61 | 31 |
| C-5 | 1.14 | 9 | 56 | 95 | 5.5 | 64 | 34 |
| Bk-6 | 1.79 | 20 | 52 | 74 | 5.4 | 72 | 29 |
| Y-6 | 1.78 | 21 | 53 | 77 | 5.4 | 72 | 28 |
| M-6 | 1.76 | 21 | 54 | 75 | 5.4 | 71 | 29 |
| C-6 | 1.81 | 19 | 55 | 74 | 5.6 | 74 | 27 |
| Bk-7 | 1.31 | 12 | 69 | 89 | 5.6 | 79 | 18 |
| Y-7 | 1.32 | 11 | 68 | 90 | 5.6 | 78 | 18 |
| M-7 | 1.31 | 12 | 67 | 91 | 5.6 | 79 | 19 |
| C-7 | 1.31 | 13 | 69 | 90 | 5.8 | 79 | 19 |
| Bk-8 | 1.16 | 16 | 44 | 92 | 5.7 | 80 | 16 |
| Y-8 | 1.16 | 15 | 45 | 92 | 5.7 | 81 | 14 |
| M-8 | 1.17 | 14 | 46 | 93 | 5.5 | 83 | 15 |
| C-8 | 1.13 | 15 | 46 | 96 | 5.7 | 84 | 14 |
| Bk-9 | 1.31 | 11 | 71 | 90 | 5.6 | 76 | 20 |
| Y-9 | 1.32 | 12 | 70 | 91 | 5.6 | 77 | 22 |
| M-9 | 1.32 | 13 | 72 | 92 | 5.6 | 79 | 23 |
| C-9 | 1.31 | 13 | 73 | 91 | 5.8 | 78 | 21 |
| Bk-10 | 1.54 | 14 | 83 | 69 | 5.9 | 79 | 18 |
| Y-10 | 1.52 | 14 | 82 | 65 | 5.5 | 78 | 18 |
| M-10 | 1.52 | 12 | 83 | 61 | 5.7 | 79 | 17 |
| C-10 | 1.53 | 13 | 83 | 63 | 5.9 | 79 | 19 |
| Bk-11 | 1.58 | 19 | 73 | 52 | 5.6 | 63 | 36 |
| Y-11 | 1.56 | 18 | 72 | 54 | 5.4 | 64 | 33 |
| M-11 | 1.57 | 19 | 73 | 51 | 5.4 | 63 | 35 |
| C-11 | 1.56 | 20 | 73 | 50 | 5.3 | 65 | 36 |

*1coefficient of variation of shape factor

*2percentage by number of particles exhibiting a shape factor of 1.2 to 1.6

*3percentage by number of particles having no corners

*4number average particle diameter

*5sum (M) of a relative frequency (m1) of toner particles contained in the highest frequency group and the relative frequency (m2) of toner particles contained in the next highest frequency group

TABLE 2

| Developer No. | Combination of Toners | Relationship (1)*1 | Relationship (2)*2 | Relationship (3)*3 | Relationship (4)*4 |
|---|---|---|---|---|---|
| 1 | Bk1/Y1/M1/C1 | 0.05 | 0.21 | 0.04 | 0.08 |
| 2 | Bk2/Y2/M2/C2 | 0.04 | 0.15 | 0.02 | 0.05 |
| 3 | Bk3/Y3/M3/C3 | 0.04 | 0.07 | 0.06 | 0.09 |
| 4 | Bk4/Y4/M4/C4 | 0.02 | 0.08 | 0.05 | 0.09 |
| 5 | Bk5/Y5/M5/C5 | 0.04 | 0.25 | 0.04 | 0.06 |
| 6 | Bk6/Y6/M6/C6 | 0.03 | 0.10 | 0.04 | 0.07 |
| 7 | Bk7/Y7/M7/C7 | 0.01 | 0.15 | 0.03 | 0.05 |
| 8 | Bk8/Y8/M8/C8 | 0.03 | 0.13 | 0.04 | 0.12 |
| 9 | Bk9/Y9/M9/C9 | 0.01 | 0.15 | 0.03 | 0.13 |
| 10 | Bk10/Y10/M10/C10 | 0.01 | 0.14 | 0.03 | 0.11 |
| 11 | Bk11/Y11/M11/C11 | 0.01 | 0.10 | 0.05 | 0.08 |
| 12 | Bk1/Y2/M3/C4 | 0.17 | 0.15 | 0.15 | 0.20 |
| 13 | Bk2/Y2/M3/C4 | 0.13 | 0.15 | 0.10 | 0.09 |
| 14 | Bk3/Y2/M2/C3 | 0.07 | 0.14 | 0.12 | 0.13 |
| 15 | Bk2/Y2/M5/C5 | 0.24 | 0.33 | 0.07 | 0.41 |

*1Relationship of maximum and minimum shape factors, represented by the foregoing formula (1),

*2Relationship of maximum and minimum coefficients of variation of shape factor of the foregoing formula (2),

*3Relationship of maximum and minimum number average particle size of the foregoing formula (3),

*4Relationship of maximum and minimum coefficients of variation of number particle size distribution of the formula (4).

The thus prepared toners were each mixed with a ferrite carrier coated with silicone resin, having a volume-average particle diameter of 60 μm to prepare a color developer having a toner concentration of 6%. Further, these color developers were combined, which were designated developers 1 to 15, as shown in Table 2.

Developers 1 to 15 were evaluated using an image forming apparatus, as shown in FIG. 12, which was provided with a non-contact development device, as shown in FIG. 13. An ultrasonic generation apparatus was operated at 40 kHz and 5 W. Under the foregoing conditions, image formation was carried out for 100,000 sheets, and the image formed on the 1st sheet and that of the 100,000th sheet were evaluated with respect to color difference. The image formation was conducted under an environment of low temperature and low humidity (10° C. and 20% RH, designated as LL environment) and under an environment of high temperature and high humidity (30° C. and 85% RH, designated as HH environment) to evaluate color reproduction. The color difference was evaluated in the following manner. Thus, using Macbeth Color-Eye 7000, solid image areas of secondary colors (red, green and blue) were measured with respect to images formed in the 1st and 100,000th sheets, and the color difference was determined based on the CMC (2:1) color difference equation. A color difference of not more than 5 was considered an acceptable level with respect to variation of tincture of the formed images.

Further, to evaluated image roughness caused at the time of image transfer or fixation, fine line images formed of dots of four color toners were compared with respect to fine line reproducibility (resolution). The resolution (expressed in lines/mm) was evaluated by observing horizontal lines (crossing the developing direction) using a 10-power hand magnifier.

TABLE 3

Evaluation Result (LL Environment)

| Example No. | Developer No. | Color Difference 1st | Color Difference 100,000th | Fine Line Reproduction (line/mm) 1st | Fine Line Reproduction (line/mm) 100,000th |
|---|---|---|---|---|---|
| 1 | 1 | 1 | 1 | 8 | 8 |
| 2 | 2 | 1 | 1 | 8 | 8 |
| 3 | 3 | 1 | 2 | 8 | 8 |
| 4 | 4 | 1 | 2 | 8 | 8 |
| 5 | 7 | 1 | 2 | 8 | 8 |
| 6 | 9 | 1 | 1 | 8 | 8 |
| 7 | 10 | 3 | 4 | 8 | 7 |
| 8 | 12 | 1 | 1 | 8 | 8 |
| 9 | 13 | 2 | 2 | 8 | 8 |
| 10 | 14 | 2 | 2 | 8 | 8 |
| Comp. 1 | 5 | 4 | 8 | 6 | 5 |
| Comp. 2 | 6 | 5 | 9 | 6 | 3 |
| Comp. 4 | 11 | 5 | 8 | 6 | 5 |
| Comp. 5 | 15 | 5 | 9 | 6 | 4 |

TABLE 4

Evaluation Result (HH Environment)

| Example No. | Developer No. | Color Difference 1st | Color Difference 100,000th | Fine Line Reproduction (line/mm) 1st | Fine Line Reproduction (line/mm) 100,000th |
|---|---|---|---|---|---|
| 1 | 1 | 1 | 1 | 8 | 8 |
| 2 | 2 | 1 | 1 | 8 | 8 |
| 3 | 3 | 1 | 2 | 8 | 8 |
| 4 | 4 | 1 | 2 | 8 | 8 |
| 5 | 7 | 1 | 2 | 8 | 8 |
| 6 | 9 | 1 | 1 | 8 | 8 |
| 7 | 10 | 3 | 4 | 8 | 7 |
| 8 | 12 | 1 | 1 | 8 | 8 |
| 9 | 13 | 2 | 2 | 8 | 8 |
| 10 | 14 | 2 | 2 | 8 | 8 |

TABLE 4-continued

| Evaluation Result (HH Environment) | | | | | |
|---|---|---|---|---|---|
| Example | Developer | Color Difference | | Fine Line Reproduction (line/mm) | |
| No. | No. | 1st | 100,000th | 1st | 100,000th |
| Comp. 1 | 5 | 4 | 8 | 6 | 5 |
| Comp. 2 | 6 | 5 | 9 | 6 | 3 |
| Comp. 4 | 11 | 5 | 8 | 6 | 5 |
| Comp. 5 | 15 | 5 | 9 | 6 | 4 |

As apparent from the foregoing results, Examples 1 to 10 resulted in reduced variation in fine line reproduction (resolution) and minimized color difference of secondary colors even in repeated image formation under the environment of low temperature and low humidity (LL environment) or under the environment of high temperature and high humidity (HH environment).

What is claimed is:

1. An image forming method comprising the steps of (a) developing an electrostatic latent image with a developer containing a toner to form a toner image on an image forming body, (b) transporting the toner image on the image forming body to a transfer region, (c) overlapping an image supporting body onto the toner image on the image forming body, (d) radiating ultrasonic waves onto the image forming body and the image supporting body by an ultrasonic radiation means with applying an electric field between the image forming body and the image supporting body to transfer the toner image onto the image supporting body, and (e) subjecting the toner image on the image supporting body to contact heat-fixing, wherein the toner is comprised of toner particles containing a resin, a colorant and a releasing agent, and the toner particles exhibiting a coefficient of variation of shape factor of not more than 16% and a coefficient of variation of number particle size distribution of not more than 27%, and wherein in step (a), uniform-charging, imagewise exposure and development to form a toner image are repeated four times, once for each toner, whereby toner image formation is obtained for each of yellow, magenta, cyan and black toners on the same region of the image forming body to form said toner image as a full-color toner image, and the toner image is then transported to the transfer region; and the ultrasonic radiation means is arranged facing the image forming body and the image supporting body without being contacted and four sets, each of which is composed of a charger, an image exposure device and a developing device, are disposed for each of the yellow, magneta, cyan and black toners.

2. The image forming method of claim 1, wherein at least 65% by number of the toner particles is accounted for by particles exhibiting a shape factor of 1.0 to 1.6.

3. The image forming method of claim 1, wherein at least 70% by number of the toner particles is accounted for by particles exhibiting a shape factor of 1.0 to 1.6.

4. The image forming method of claim 1, wherein at least 65% by number of the toner particles is accounted for by particles exhibiting a shape factor of 1.2 to 1.6.

5. The image forming method of claim 1, wherein the coefficient of variation of shape factor is not more than 14%.

6. The image forming method of claim 1, wherein at least 50% by number of the toner particles is accounted for by particles having no corners.

7. The image forming method of claim 1, wherein at least 70% by number of the toner particles is accounted for by particles having no corners.

8. The image forming method of claim 1, wherein the toner particles meet the following requirement:

$$M = m1 + m2 \geqq 70\ (\%)$$

wherein in a histogram of number particle size distribution based on number in which a toner particle size is designated D (μm), natural logarithmic lnD is laid off as abscissa and the abscissa is divided into plural groups at an interval of 0.23, M is the sum of m1 and m2 in which m1 is a relative frequency (%) of toner particles contained in the highest frequency group and m2 is a relative frequency (%) of toner particles contained in the next highest frequency group.

9. The image forming method of claim 1, wherein the releasing agent is a compound represented by the following formula:

$$R_1—(OCO—R_2)_n$$

wherein $R_1$ and $R_2$ are each a hydrocarbon group; and n is an integer of 1 to 4.

10. The image forming method of claim 1, wherein the ultrasonic radiation means is arranged downstream of the direction of transporting the toner image on the image forming body from a means for applying an electric field.

* * * * *